US008317458B2

(12) United States Patent
Rivas et al.

(10) Patent No.: US 8,317,458 B2
(45) Date of Patent: Nov. 27, 2012

(54) APPARATUS AND METHOD FOR DOUBLE FLOW TURBINE TUB REGION COOLING

(75) Inventors: Flor Del Carmen Rivas, Clifton Park, NY (US); William Thomas Parry, Rexford, NY (US); Jon-Paul James Cronier, Scotia, NY (US)

(73) Assignee: General Electric Company, Schenectady, NY (US)

( * ) Notice: Subject to any disclaimer, the term of this patent is extended or adjusted under 35 U.S.C. 154(b) by 1309 days.

(21) Appl. No.: 12/038,892

(22) Filed: Feb. 28, 2008

(65) Prior Publication Data

US 2009/0217673 A1 Sep. 3, 2009

(51) Int. Cl.
*F01D 5/08* (2006.01)

(52) U.S. Cl. ..... 415/1; 415/94; 415/103; 415/115; 415/144; 415/180; 416/1; 416/97 R

(58) Field of Classification Search ..... 415/93, 415/94, 103, 115, 116, 144, 178, 180; 416/90 R, 416/91, 93 R, 95, 96 R, 97 R, 144
See application file for complete search history.

(56) References Cited

U.S. PATENT DOCUMENTS

| | | | | | |
|---|---|---|---|---|---|
| 3,291,447 | A * | 12/1966 | Brandon | 415/111 |
| 3,321,179 | A * | 5/1967 | Johnson et al. | 415/136 |
| 3,429,557 | A * | 2/1969 | Brandon et al. | 415/58.7 |
| 3,817,654 | A * | 6/1974 | Sohma | 415/103 |
| 4,425,079 | A * | 1/1984 | Speak et al. | 415/139 |
| 4,571,153 | A * | 2/1986 | Keller | 415/117 |
| 4,634,340 | A * | 1/1987 | Stetter | 415/95 |
| 4,776,765 | A * | 10/1988 | Sumner et al. | 416/241 R |
| 4,961,310 | A * | 10/1990 | Moore et al. | 60/39.182 |
| 5,024,579 | A * | 6/1991 | Groenendaal et al. | 415/108 |
| 5,593,273 | A * | 1/1997 | Brinkman | 415/108 |
| 6,077,035 | A * | 6/2000 | Walters et al. | 415/115 |
| 6,082,962 | A * | 7/2000 | Drosdziok et al. | 415/115 |
| 6,945,749 | B2 * | 9/2005 | De Cardenas | 415/115 |
| 2005/0047914 | A1 * | 3/2005 | Tomberg | 416/97 R |
| 2007/0065273 | A1 | 3/2007 | Cornell | |
| 2010/0038917 | A1 * | 2/2010 | Diantonio et al. | 290/4 |

* cited by examiner

*Primary Examiner* — Igor Kershteyn
(74) *Attorney, Agent, or Firm* — Cantor Colburn LLP

(57) ABSTRACT

A steam turbine includes a turbine rotor, a generator end having a generator end first stage with a first reaction, and a turbine end having a turbine end first stage with a second reaction not equal to the first reaction. The steam turbine includes a tub section disposed between the generator end and the turbine end, the turbine rotor and the tub section defining an annulus therebetween. A difference between the first reaction and second reaction is capable of urging a steam flow through the annulus for reducing a temperature of the turbine rotor. A method of cooling the turbine rotor is also disclosed.

18 Claims, 3 Drawing Sheets

APPARATUS AND METHOD FOR DOUBLE FLOW TURBINE TUB REGION COOLING

BACKGROUND

The subject invention relates to steam turbines. More particularly, the subject invention relates to cooling a tub region of a double-flow steam turbine.

Double-flow steam turbines typically include two parallel flow turbine ends arranged on a common shaft. A tub section is often located between the turbine ends and disposed around the shaft. Steam flows into the steam turbine radially inwardly toward the tub section, and the steam flow then divides, turns axially, and flows in opposing directions to enter each of the two parallel flow turbine ends.

Steam flow may become stagnant between the rotor and the tub section of the double-flow steam turbine resulting in a high temperature on the rotor due to windage heating of the stagnant steam. High rotor temperature potentially shortens the useful life of the rotor and may lead to failure of the steam turbine.

BRIEF DESCRIPTION OF THE INVENTION

A steam turbine is provided which includes a turbine rotor, a first generator end having a generator end first stage with a first reaction, and a turbine end having a turbine end first stage with a second reaction not equal to the first reaction. The steam turbine includes a tub section disposed between the generator end and the turbine end, the turbine rotor and the tub section defining an annulus therebetween. A difference between the first reaction and second reaction is capable of urging a steam flow through the annulus for reducing a temperature of the turbine rotor. A method for cooling a tub section of the steam turbine includes urging a steam flow into the steam turbine including a turbine rotor, a generator end having a generator end first stage with a first reaction, a turbine end having a turbine end first stage with a second reaction less than the first reaction, and a tub section disposed between the generator end and the turbine end, the turbine rotor and the tub section defining an annulus therebetween. The method further includes flowing the steam flow through the generator end first stage and urging at least a portion of the steam flow through the annulus, by a difference between the second reaction and the first reaction for reducing the temperature of the turbine rotor. The portion of the steam flowed is then flowed from the annulus into the turbine end.

These and other advantages and features will become more apparent from the following description taken in conjunction with the drawings.

BRIEF DESCRIPTION OF THE DRAWINGS

The subject matter which is regarded as the invention is particularly pointed out and distinctly claimed in the claims at the conclusion of the specification. The foregoing and other objects, features, and advantages of the invention are apparent from the following detailed description taken in conjunction with the accompanying drawings in which:

The detailed description explains embodiments of the invention, together with advantages and features, by way of example with reference to the drawings.

DETAILED DESCRIPTION OF THE INVENTION

Figure 1:
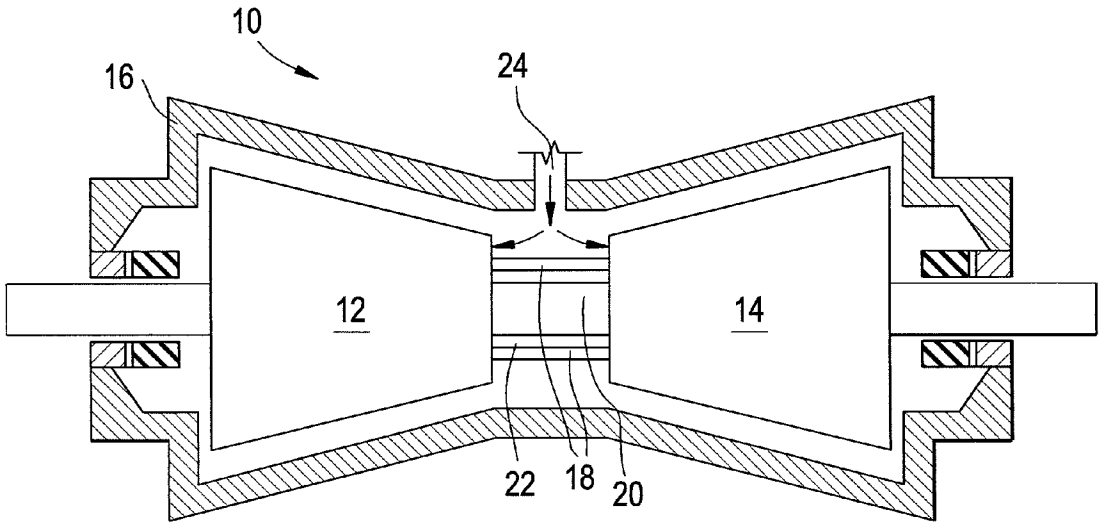
FIG. 1 is a schematic view of an example of a double-flow steam turbine.

Shown in FIG. 1 is a schematic representation of a double-flow steam turbine 10. Steam turbine 10 includes a generator end 12 disposed nearest to a generator (not shown) and a turbine end 14 disposed farthest from the generator, and the generator end 12 and turbine end 14 may be disposed in an outer case 16. A double flow tub section 18 is disposed axially between the generator end 12 and the turbine end 14 and radially outboard of a rotor 20. The rotor 20 may comprise, for example, a drum rotor or at least one rotor disk disposed on a rotor shaft. The rotor 20 and the tub section 18 are configured and disposed to define an annulus 22 between the rotor 20 and the tub section 18. Steam enters the steam turbine 10 at an inlet 24 which is disposed radially outboard of the rotor 20 and the tub section 18. Steam entering the steam turbine 10 at the inlet 24 flows toward the tub section 18, divides, and then enters either of the generator end 12 or the turbine end 14.

Figure 2:
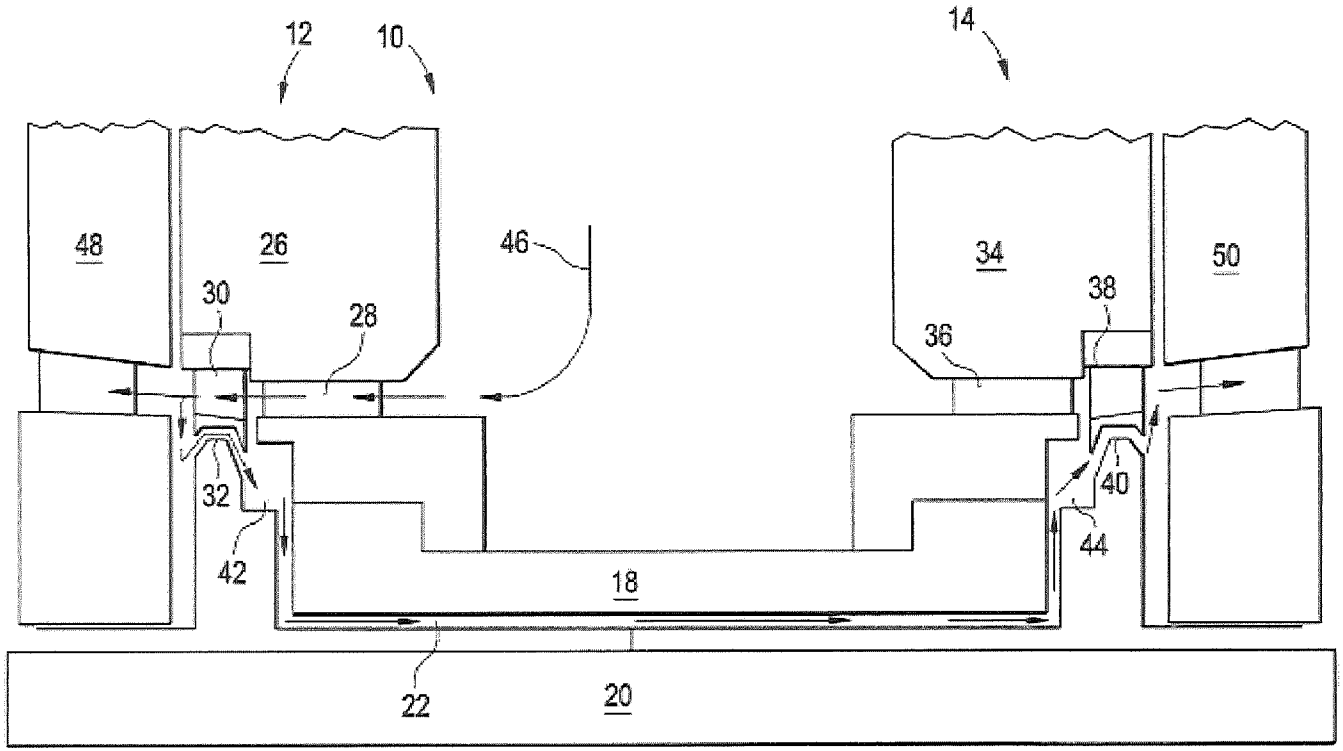
FIG. 2 is a cross-sectional view of an example of a double-flow steam turbine having a cooling flow through a tub section.

Referring now to FIG. 2, the generator end 12 includes a generator end first stage 26 which comprises a plurality of generator end nozzles 28 which in some embodiments are disposed in the tub section 16, and a plurality of generator end buckets 30. The generator end buckets 30 are mounted on the rotor 20. In some embodiments, the rotor 20 may include a plurality of generator end balance holes 32 which may include wheel holes and/or dovetail holes located radially inboard from the generator end buckets 30, or alternatively in the generator end buckets 30. Similarly, the turbine end 14 includes a turbine end first stage 34 which comprises of a plurality of turbine end nozzles 36 and a plurality of turbine end buckets 38. The turbine end buckets 38 are on the rotor 20. In some embodiments, a plurality of turbine end balance holes 40 may be located radially inboard from the turbine end buckets 38, or alternatively in the turbine end buckets 38.

The generator end 12 and turbine end 14 are configured to produce a pressure differential between a first annulus end 42 and a second annulus end 44 so that a cross-flow 46 through the annulus 22 is created by the pressure differential. In some embodiments, this is achieved by configuring one of the generator end first stage 26 or the turbine end first stage 34 to have a negative reaction and the other of the generator end first stage 26 or the turbine end first stage 34 to have a positive reaction. "Reaction", as used herein, refers to a ratio of a static pressure drop over the buckets to a total pressure drop across both the nozzles and buckets for the particular stage. In a stage having negative reaction, a bucket exit pressure is greater than a nozzle exit pressure.

In the embodiment of FIG. 2, the generator end first stage 26 is configured with a negative reaction, and the turbine end first stage 34 is configured with a positive reaction. Further, an exit pressure of the generator end buckets 30 is greater than an exit pressure of the turbine end buckets 38. Configuring the steam turbine 10 to include a negative reaction at the generator end first stage 26 and a positive reaction at the turbine end first stage 34 initiates a flow pattern to cool the rotor 20 in the annulus 22. When the steam turbine 10 is operating, this results in a steam flow as shown by arrows 46. The steam flow 46 passes through the generator end nozzles 28 and through the corresponding generator end buckets 30. A portion of the flow proceeds to a generator end second stage 48 while another portion flows through the generator end balance holes 32, or other through holes or pathways, through rotor 20 and proceeds to the annulus 22 between the tub section 18 and the rotor 20. The steam flow 46 proceeds through the annulus 22 to turbine end 14. The steam flow 46 flows through the turbine end balance holes 40, or other holes or pathways, and to a turbine end second stage 50. The steam flow 46 through the annulus 22 provides cooling to rotor 20 adjacent to the annulus 22 thereby limiting exposure of the rotor 20 to temperatures that would shorten the useful life of the rotor 20 and potentially damage the steam turbine 10. Similarly, it is to be appreciated that configuring the generator end first stage 26 to have a positive reaction and the turbine end first stage 34 to have a negative reaction would establish a similar steam flow 46 through the annulus 22 but in the opposite direction.

In some embodiments, generator end balance holes 32 and/or turbine end balance holes 40 may not be provided. In a steam turbine 10 with such a configuration, a portion of the steam flow 46 passes between the generator end nozzles 28 and generator end buckets 30 and into the annulus 22. The steam flow 46 proceeds through the annulus 22 to turbine end 14, and between turbine end nozzles 36 and the turbine end buckets 38 and then through the turbine end buckets 38.

Figure 3:
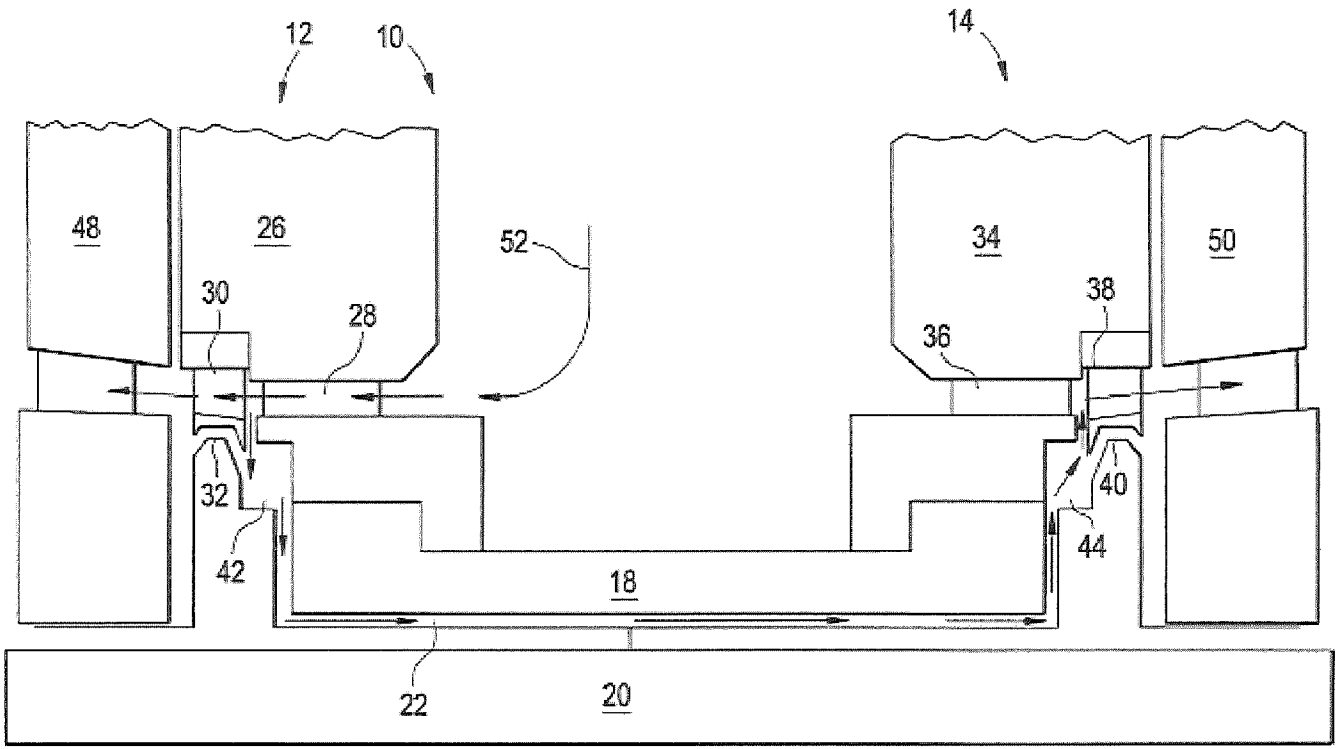
FIG. 3 is a cross-sectional view of another example of a double-flow steam turbine having a cooling flow through a tub section.

In some embodiments, the steam turbine 10 is configured such that both the generator end first stage 26 and turbine end first stage 34 have positive reactions, but the reaction of one of the generator end first stage 26 and turbine end first stage 34 is greater than the other of the generator end first stage 26 and turbine end first stage 34. Referring to FIG. 3, this configuration produces a cooling flow 52. The cooling flow 52 proceeds through the generator end nozzles 28, a portion continuing through the generator end buckets 30 and another portion proceeding between the generator end nozzles 28 and generator end buckets 30 and into the annulus 22. The cooling flow 52 proceeds through the annulus 22 and to the turbine end 14 where it passes between the turbine end nozzles 36 and the turbine end buckets 38 and then through the turbine end buckets 38. The cooling flow 52 has a higher temperature than the steam flow 46 since the cooling flow 52 does not have energy removed by, and thus temperature lowered by, passing through the generator end buckets 30 prior to entering the annulus 22.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

The invention claimed is:

1. A steam turbine comprising:
- a turbine rotor;
- a generator end having a generator end first stage with a first reaction, the generator end first stage including:
  - a plurality of generator end nozzles; and
  - a plurality of generator end buckets;
- a turbine end having a turbine end first stage with a second reaction not equal to the first reaction; and
- a tub section disposed between the generator end and the turbine end, the turbine rotor and the tub section defining an annulus therebetween, a difference between the first reaction and second reaction capable of urging a steam flow between the plurality of generator end nozzles and the plurality of generator end buckets and through the annulus for reducing a temperature of the turbine rotor.

2. The steam turbine of claim 1 wherein the first reaction is a negative reaction and the second reaction is a positive reaction.

3. The steam turbine of claim 1 wherein the generator end first stage comprises:
- a plurality of generator end nozzles; and
- a plurality of generator end buckets disposed at the turbine rotor.

4. The steam turbine of claim 3 wherein the turbine rotor includes at least one through hole capable of directing steam flow from the generator end first stage to the annulus.

5. The steam turbine of claim 3 wherein the generator end buckets include at least one through hole capable of directing steam flow from the generator end first stage to the annulus.

6. The steam turbine of claim 1 wherein the turbine end first stage includes a plurality of turbine end buckets disposed at the turbine rotor.

7. The steam turbine of claim 6 wherein the turbine rotor includes at least one through hole capable of directing fluid from the annulus into the turbine end.

8. The steam turbine of claim 6 wherein the turbine end buckets include at least one through hole capable of directing fluid from the annulus into the turbine end.

9. The steam turbine of claim 1 wherein a reaction of the turbine end first stage is greater than a reaction of the generator end first stage, thus capable of urging a steam flow through the annulus for reducing a temperature of the turbine rotor.

10. A method of cooling rotor of a steam turbine comprising:
- urging a steam flow into the steam turbine including:
  - a turbine rotor
  - a generator end having a generator end first stage with a first reaction, the generator end first stage including:
    - a plurality of generator end nozzles; and
    - a plurality of generator end buckets;
    - a turbine end having a turbine end first stage with a second reaction less than the first reaction; and
    - a tub section disposed between the generator end and the turbine end, the turbine rotor and the tub section defining an annulus therebetween;
- flowing the steam flow into the generator end first stage;
- urging at least a portion of the steam flow between the plurality of generator end nozzles and the plurality of generator end buckets and through the annulus, by a difference between the second reaction and the first reaction for reducing a temperature of the turbine rotor; and
- flowing the portion of the steam flow from the annulus into the turbine end.

11. The method of claim 10 wherein flowing the steam flow through the generator end first stage comprises:
- flowing the steam flow through a plurality of generator end nozzles; and
- flowing the steam flow through a plurality of generator end buckets.

12. The method of claim 11 including flowing the portion of steam flow from the generator end first stage to the annulus through a first opening between the plurality of generator end nozzles and the plurality of generator end buckets.

13. The method of claim 10 including flowing the portion of steam flow into the turbine end through a second opening between a plurality of turbine end nozzles and a plurality of turbine end buckets.

14. The method of claim 10 wherein the second reaction is a positive reaction and the first reaction is a negative reaction.

15. The method of claim 10 including flowing the portion of steam flow from the generator end first stage to the annulus through at least one through hole in the turbine rotor.

16. The method of claim 10 including flowing the portion of steam flow from the generator end first stage to the annulus through at least one through hole in the generator end buckets.

17. The method of claim 10 including flowing the portion of steam flow into the turbine end through at least one through hole in the turbine rotor.

18. The method of claim 10 including flowing the portion of steam flow into the turbine end through at least one through hole in the turbine end buckets.

* * * * *